US006985046B2

(12) United States Patent
Schilling

(10) Patent No.: US 6,985,046 B2
(45) Date of Patent: Jan. 10, 2006

(54) DEVICE FOR THE TRANSMISSION OF ELECTRIC SIGNALS BETWEEN AT LEAST TWO UNITS MOBILE RELATIVE TO EACH OTHER

(75) Inventor: Harry Schilling, Eichstätt (DE)

(73) Assignee: Schleifring und Apparatebau GmbH, Fü rstenfeldbruck (DE)

( * ) Notice: Subject to any disclaimer, the term of this patent is extended or adjusted under 35 U.S.C. 154(b) by 233 days.

(21) Appl. No.: 10/425,558

(22) Filed: Apr. 29, 2003

(65) Prior Publication Data

US 2003/0214421 A1 Nov. 20, 2003

(30) Foreign Application Priority Data

May 3, 2002 (DE) ..... 102 19 958

(51) Int. Cl.
*H01P 1/06* (2006.01)

(52) U.S. Cl. ..... 333/24 R; 333/261

(58) Field of Classification Search ..... 333/24 R, 333/32, 261

See application file for complete search history.

(56) References Cited

U.S. PATENT DOCUMENTS

| | | | | |
|---|---|---|---|---|
| 5,530,425 A | | 6/1996 | Harrison | 340/500 |
| 6,437,656 B1 | * | 8/2002 | Guynn et al. | 333/24 R |

FOREIGN PATENT DOCUMENTS

| | | | |
|---|---|---|---|
| DE | 196 01 965 | | 7/1997 |
| DE | 196 27 628 | | 1/1998 |
| DE | 298 00 281 | | 6/1999 |
| JP | 8-273789 A | * | 10/1996 |

* cited by examiner

*Primary Examiner*—Dean Takaoka
(74) *Attorney, Agent, or Firm*—Kevin L. Daffer; Daffer McDaniel, LLP

(57) ABSTRACT

In a device for the transmission of electrical signals between at least two units mobile relative to each other, such as a slip ring or a sliding path, a shielding surface of an electrically conductive material is provided to reduce interference radiation and interference sensitivity, and to diminish a coupling with adjacent paths.

9 Claims, 6 Drawing Sheets

DEVICE FOR THE TRANSMISSION OF ELECTRIC SIGNALS BETWEEN AT LEAST TWO UNITS MOBILE RELATIVE TO EACH OTHER

BACKGROUND OF THE INVENTION

1. Field of the Invention

The present invention relates to systems for the electrical transmission between two units mobile relative to each other. These systems are employed, for example, as linear sliding paths in units designed for linear movement such as crane installations or as slip rings for rotary transmission, e.g. in computer tomographs.

2. Description of Related Art

For slip rings or sliding paths, both contacting and non-contacting transmission techniques are known. As the engineering principle of their function for rotary transmission and the functional principle for linear or curved transmission are one and the same, a more detailed distinction will not be made between these techniques in the following. The terms will be used synonymously. The operation of a contacting transmission will be briefly explained below with reference to the example of a slip ring. Circular or annular sliding paths are mounted on a first unit. A second unit, with a sliding contact resting on the sliding path and in sliding contact with the latter during the movement, is moving relative to this first unit. Now an electric current can be transmitted via this galvanic contact.

It is equally possible to move the sliding contact at a small distance above the sliding path so that there is an exclusively capacitive coupling between the sliding path and the sliding contact. High-frequency signals or high-frequency signal fractions can be transmitted via this capacitive coupling without any problems.

Various technologies have become known for the mechanical structure of such slip rings. For example, solid sliding paths turned from cylindrical metal bodies can be stacked together with insulating bodies to form a slip ring with several transmission paths. Such slip rings excel themselves by a long service life. However, the manufacturing costs are comparatively high.

Slip rings realized on PC boards in the form of printed circuits are mostly more expedient to manufacture. One example of such a slip ring is disclosed in the German Patent Application DE 196 01 965 A1. Here, the sliding path is a circular conducting path on the PC board. However, in that case, a number of specific additional steps of operation are required in manufacture, compared against the conventional PCB technology. For instance, the conducting path is provided with a surface coating consisting of silver or gold. Such slip rings can be manufactured at lower costs than the previously described solid slip rings but their service life is shorter. A slip ring manufactured with application of the PCB technique is disclosed in the German Patent Application DE 196 01 965 A1, for example.

Slip rings are easier to manufacture in the so-called stacking technique that is disclosed, for instance, in the German Utility Model DE 298 00 281 U1. These rings consist of strata of electrically conductive material and insulating material, which are stacked in alternation.

Such slip ring technologies are well suitable for the transmission of low-frequency direct current or alternating current. For higher frequencies, a defined natural impedance and a defined shielding are required. The defined natural impedance is necessary in order to permit a reflection-free transmission. When the natural impedance varies along the slip ring or when it does not correspond to the natural impedance of the connected lines, reflections may occur that result in interference with or distortion of the transmitted signal.

Moreover, particularly in the case of higher frequencies, a defined shielding is desirable in order to comply, on the one hand, with the applicable EMO standards and, on the other hand, to reduce the crosstalk with neighboring lines. Hence, cross coupling or crosstalk between neighboring slip ring paths is one of the most annoying problems in the transmission of high-frequency signals. For the reduction of crosstalk, a solution based on balancing transformers, for example, is known from the German Patent Application DE 19627628 A1. That solution entails the advantage, however, that the respective balancing transformers must be matched with the respective conditions in terms of impedance and frequency. Moreover, the voltage-proof characteristics of the transformer reduce the voltage-proof characteristics of the system as a whole. This transformer limits, as a rule, also the ampacity.

The U.S. Pat. No. 5,530,425 discloses another approach. There, the sliding paths are accommodated in a metal-plated trough. This solution is very expensive and consumes much space. For example, in production in a solid plastic support it is necessary to turn the trough out and to provide it with an adhesive metal film or a galvanic metallized layer bearing a conductive coating on the inside.

BRIEF SUMMARY OF THE INVENTION

The present invention is based on the problem of improving slip rings or sliding paths in such a manner that, compared against prior art, they will permit an improved transmission of high-frequency signals, without being detrimental to the transmission characteristics (voltage-proof characteristics, ampacity, service life, etc.) of the slip ring or the sliding path. Moreover, a low-cost manufacture should be possible.

The inventive device for the transmission of electric energy between at least two units mobile relative to each other comprises a conductor path of electrically conductive material, which is disposed along the path of movement, as well as a tap mobile along this conducting path for coupling or decoupling electric signals. Moreover, at least one shielding surface of electrically conductive material is provided for shielding between neighbouring paths, which surface projects beyond the height of the conductor paths and is connected to at least one shield of one of the feeder or output lines.

BRIEF DESCRIPTION OF THE DRAWINGS

In the following the invention will be described by exemplary embodiments, without any limitation of the general inventive idea, with reference to the drawing wherein.

LIST OF REFERENCE NUMERALS

Figure 1:
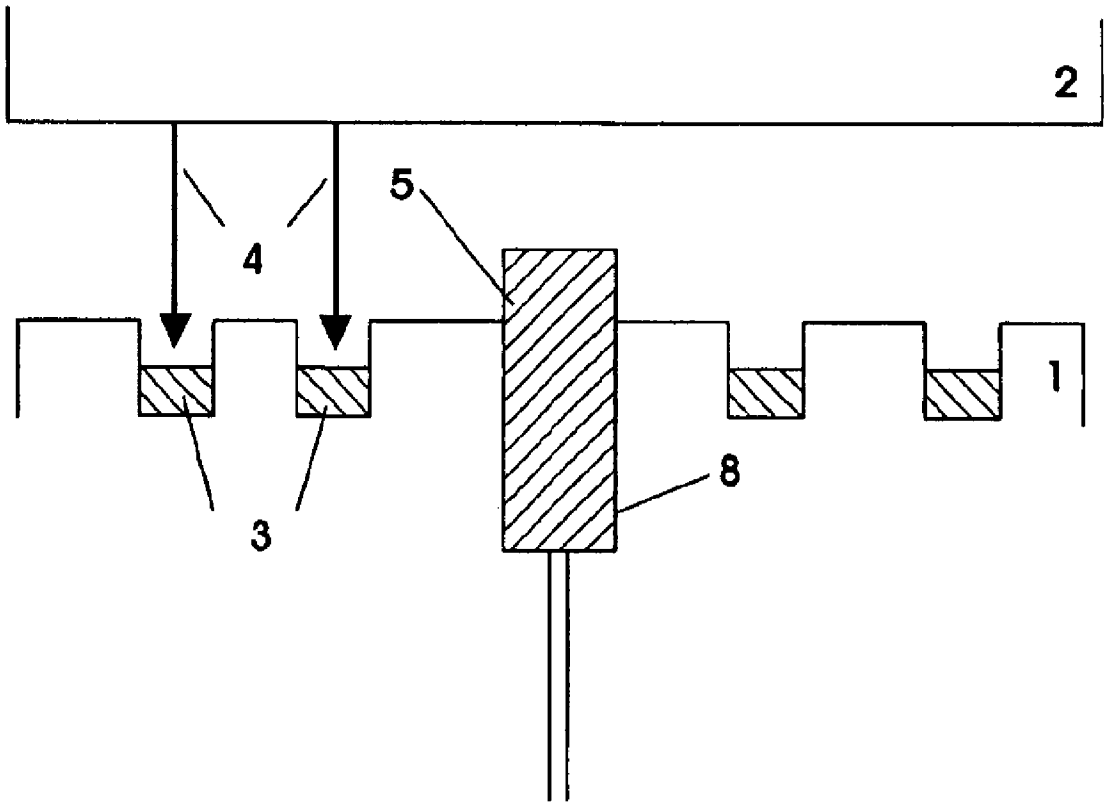
FIG. 1 is a general schematic view of an inventive device.

1 first unit
2 second unit
3 conductor path
4 tap
5 shielding surface
6 conductive rear wall
7 conductor path support
8 groove
9 insulated support
10 connecting point.

DETAILED DESCRIPTION OF THE INVENTION

In an expedient embodiment of the invention, the shielding surface comprises a ground connection. According to an alternative, the connection to a shield of a cable is possible, too, which is optionally connected to the conductor path or the tap.

In a further expedient embodiment of the invention, shielding surfaces are arranged on both sides of a conductor path. With this arrangement, a sound shielding of the conductor path can be achieved. Compared with the previously described metallized trough, this arrangement presents the advantage that it is substantially easier to produce at essentially lower costs. Tests have shown that an inventive device permits the achievement of good shielding levels that are similar to those achievable with the metallized trough. The reason for this resides in the aspect that slip rings or siding paths are mostly applied on a metal support. As a matter of fact, however, there is an electric insulation between the sliding paths and the metal support of the slip ring. Even though this metal rear side is not directly connected to the shielding surfaces, it achieves yet a sound shielding effect.

Another embodiment of the invention provides for a conductive, preferably metallized rear wall that is connected by one point, preferably, however, by several points, to one or several shielding surfaces.

In a further expedient embodiment of the invention, a pair of conductor paths is provided for the transmission of differential signals, which pair comprises shielding surfaces in symmetrical arrangement on both sides. The arrangement of the two conductor paths is preferably designed in such a way that they present the desired impedance or capacitance relative to each other whilst they have a higher impedance or capacitance relative to the shielding surfaces. The impedance of the conductors is here substantially determined by the mutual capacitance of the conductors because the inductance is almost constant.

According to another expedient embodiment of the invention, several shielding surfaces are provided between neighboring conductor paths. These shielding surfaces are then associated with the respective conductor paths disposed next to them. Such an arrangement is sensible particularly when the shields associated with the conductor paths are isolated from each other as well. This is necessary specifically when signals are supplied through different coaxial cables whose shields are not connected to each other.

In a further expedient embodiment of the invention, the shielding surface is received in a groove of a sliding path support.

According to another expedient embodiment of the invention, an additional groove is formed in the conductor path support in order to reduce the capacitance between the conductor paths.

FIG. 1 is a schematic cross-sectional view of an inventive device. A second unit 2 is arranged for movement relative to a first unit 1. The first unit 1 comprises several conductor paths 3 disposed along the path of movement. Taps 4 on the second unit 2 serve to couple or decouple electric signals into the conductor path or out of the conductor path, respectively. In view of the manifold types and models, these taps are only represented here in a schematic form. For example, they may be wire springs, flexible strips or metal tissues or even carbon elements. A shielding surface 5 is inserted between the conductor paths in a groove 8.

Figure 2:
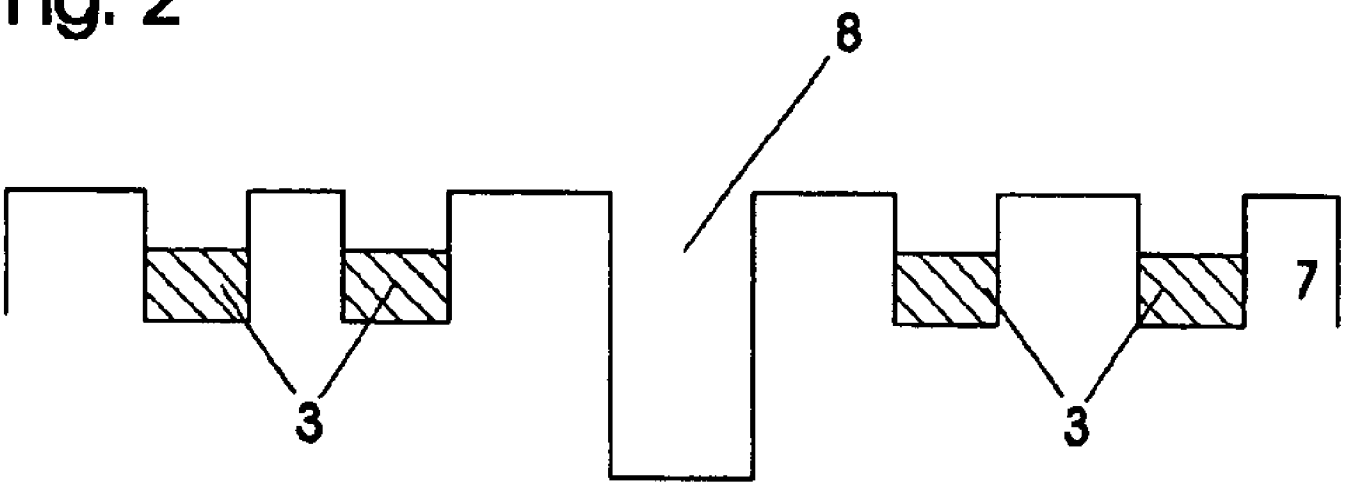
FIG. 2 represents an arrangement including multiple means for contacting the conductor path.

FIG. 2 is a sectional view of another embodiment of the invention wherein a groove 8 is provided between conductor paths 3 for a reduction of the capacitance between the conductor paths. This reduction of the capacitance also entails a corresponding reduction of the level of coupling between the conductor paths.

Figure 3:
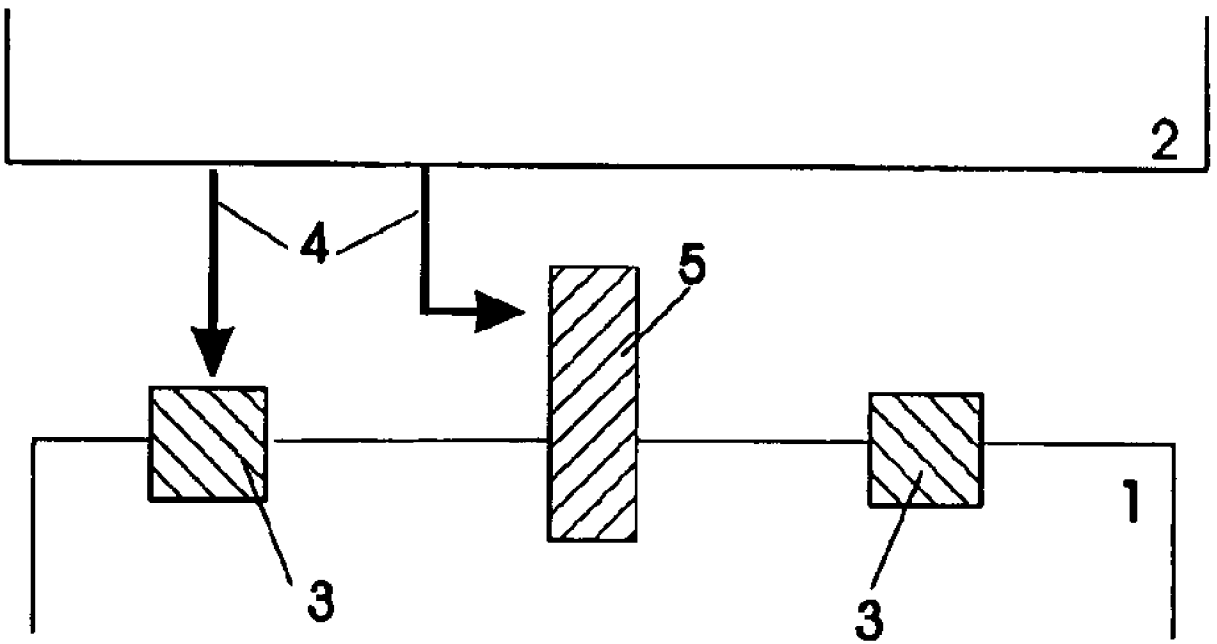
FIG. 3 shows an arrangement including an additional tap towards the shielding surface.

FIG. 3 shows a further embodiment of the invention wherein an additional tap 4 towards shielding surfaces 5 is provided.

Figure 4:
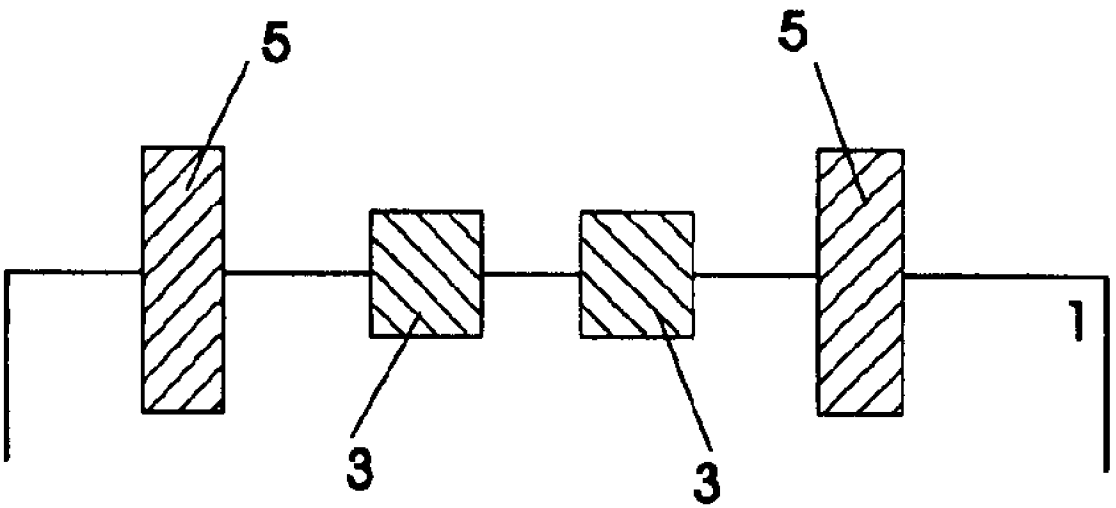
FIG. 4 is a view of a symmetric arrangement with symmetric shielding surfaces.

FIG. 4 is an illustration of a symmetric arrangement of the type that is suitable, in particular, for the operation on symmetric signals. The two conductor paths 3 are here operated with symmetric signals. Moreover, two symmetrically disposed shielding surfaces 5 are provided for shielding.

Figure 5:
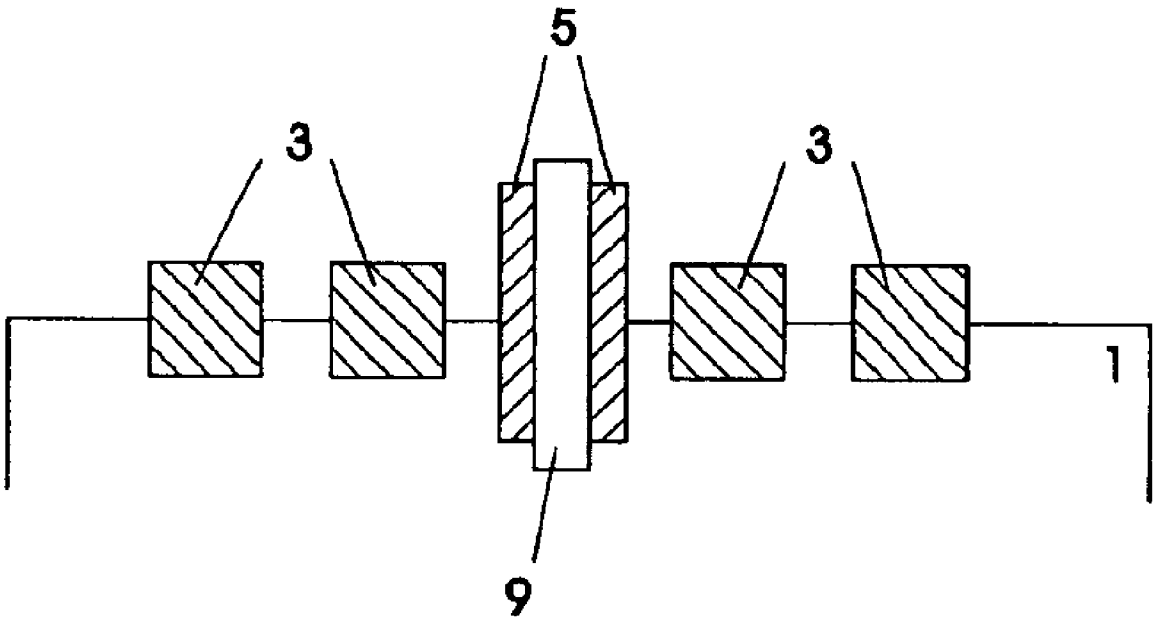
FIG. 5 illustrates an arrangement with isolated shielding surfaces.

FIG. 5 is a view of an arrangement including isolated or separate shielding surfaces 5 that are insulated from each other by an insulated support 9. Hence, the shielding surfaces on the left side of the isolated support may be associated with the conductor paths 3 that are also arranged on the left side. This is necessary, for instance, whenever the conductor paths on the left side are supplied by means of a separate cable whose shield is connected to the shielding surface on the left side of the insulated support. It is equally possible now to supply the arrangement on the right side of the insulated support, which comprises two conductor paths and one shield surface, by means of a second cable that is completely isolated from the first cable.

Figure 6:
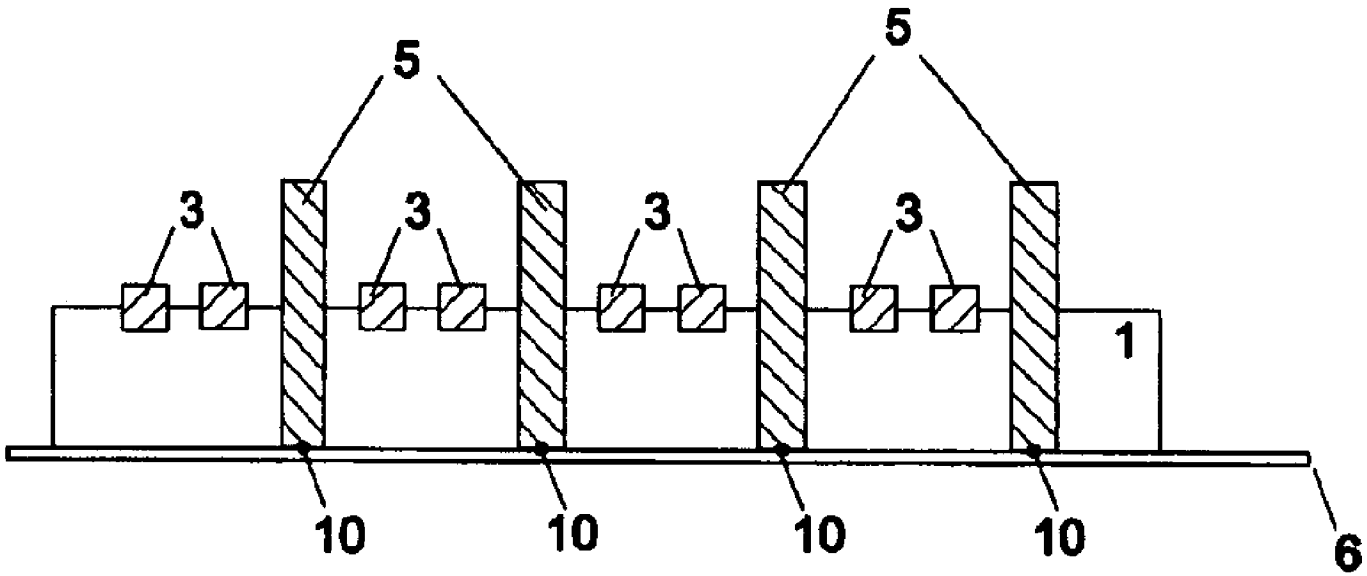
FIG. 6 shows an arrangement composed of several pairs of conductor paths with shielding surfaces that are connected to a conductive rear wall.

FIG. 6 is an exemplary illustration of a multiple arrangement consisting of a plurality of pairs of conductor paths as well as shielding surfaces disposed therebetween. The shielding surfaces are connected via the connecting points 10 to a conductive rear wall 6. The shielding surfaces expediently do not rest flatly on the isolated rear wall but have teeth, for instance, on the side facing the rear wall, which are similar to the teeth on a gear wheel. These teeth can penetrate through the electric insulating material that serves as basis of the first unit 1, and ensure a reliable connection of the entire unit. An electric connection can be optionally established at one point or at several points.

What is claimed is:

1. A device for transmitting electrical signals between at least two units mobile relative to each other, comprising:

a first unit comprising least one conductor path of electrically conducting material along a path of movement;

a second unit comprising at least one tap mobile along the at least one conductor path for coupling electrical signals into, or decoupling electrical sign als from the at least one conductor path;

a shielding surface of electrically conductive material projecting beyond a height of the at least one conductor path; and wherein the shielding surface comprises a ground connection, or is connected to a shield of a cable that is optionally connected to the at least one conductor path or the at least one tap.

2. The device according to claim 1, wherein contacting points on the at least one conductor path are present in a number that is different from a number in which the taps are present.

3. The device according to claim 1, wherein shielding surfaces are provided on both sides of the conductor path.

4. The device according to claim 1, wherein at least one point of at least one shielding surface is connected to at least one electrically conducting rear wall.

5. The device according to claim 1, wherein the first unit comprises a pair of conductor paths for transmitting differential signals, the pair of conductor paths being connected to shielding surfaces on both sides.

6. The device according to claim 1, wherein a plurality of shielding surfaces are provided between adjacent conductor paths.

7. The device according to claim 1, wherein at least on shielding surface in a groove of a conductor path support.

8. The device according to claim 1, wherein a groove is formed in a conductor path support to reduce a capacitance between conductor paths.

9. The device according to claim 1, wherein a plurality of taps are connected to each other and simultaneously contact one conductor path at a plurality of sites.

* * * * *

UNITED STATES PATENT AND TRADEMARK OFFICE

CERTIFICATE OF CORRECTION

PATENT NO. : 6,985,046 B2
APPLICATION NO. : 10/425558
DATED : January 10, 2006
INVENTOR(S) : Schilling It is certified that error appears in the above-identified patent and that said Letters Patent is hereby corrected as shown below:

In the Claims:

Col. 4, line 59: Please delete "sign als" and substitute therefor --signals--.

Col. 5, line 9: Please delete "conducting" and substitute therefor --conductive--.

Col. 6
line 4: Please delete "on" and substitute therefor --one--.
line 5: Please insert --is received-- after the phrase "shielding surface."

Signed and Sealed this

Second Day of January, 2007

JON W. DUDAS
*Director of the United States Patent and Trademark Office*